US008375839B2

(12) United States Patent
Landi

(10) Patent No.: US 8,375,839 B2
(45) Date of Patent: Feb. 19, 2013

(54) LIGHTWEIGHT ARMOR AND BALLISTIC PROJECTILE DEFENSE APPARATUS

(75) Inventor: Curtis L. Landi, San Jose, CA (US)

(73) Assignee: Supracor, Inc., San Jose, CA (US)

( * ) Notice: Subject to any disclaimer, the term of this patent is extended or adjusted under 35 U.S.C. 154(b) by 1574 days.

(21) Appl. No.: 11/897,548

(22) Filed: Aug. 29, 2007

(65) Prior Publication Data

US 2012/0174748 A1 Jul. 12, 2012

(51) Int. Cl.
*F41H 5/04* (2006.01)

(52) U.S. Cl. ..... 89/36.02; 89/904; 89/916; 428/911

(58) Field of Classification Search ..... 89/36.01, 89/36.02, 36.04; 428/911
See application file for complete search history.

(56) References Cited

U.S. PATENT DOCUMENTS

| | | | | |
|---|---|---|---|---|
| 5,344,689 | A * | 9/1994 | Ide et al. | 428/114 |
| 5,362,527 | A | 11/1994 | Harpell et al. | |
| 5,667,866 | A * | 9/1997 | Reese, Jr. | 428/116 |
| 5,789,699 | A * | 8/1998 | Stewart et al. | 102/521 |
| 5,830,548 | A | 11/1998 | Anderson et al. | |
| 6,253,655 | B1 | 7/2001 | Lyons et al. | |
| 2001/0015157 | A1 | 8/2001 | Neal | |
| 2001/0030017 | A1 * | 10/2001 | Sato | 156/199 |
| 2003/0183814 | A1 * | 10/2003 | Marsh et al. | 256/1 |
| 2004/0067364 | A1 * | 4/2004 | Ishikawa et al. | 428/411.1 |
| 2004/0168246 | A1 * | 9/2004 | Phillips | 2/411 |
| 2005/0005762 | A1 * | 1/2005 | Lujan | 89/36.02 |
| 2005/0229771 | A1 * | 10/2005 | Lewis | 89/36.02 |
| 2008/0230652 | A1 * | 9/2008 | Biornstad et al. | 244/120 |
| 2009/0065643 | A1 * | 3/2009 | Park | 244/122 R |
| 2009/0324966 | A1 * | 12/2009 | Benitsch et al. | 428/428 |
| 2010/0089228 | A1 * | 4/2010 | Scott et al. | 89/36.02 |

* cited by examiner

*Primary Examiner* — Bret Hayes
(74) *Attorney, Agent, or Firm* — IPXLAW Group LLP; Claude A. S. Hamrick

(57) ABSTRACT

Ballistic resistant armor material and assembly including a thin, rigid armor component for stopping and capturing ballistic projectiles, backed by a resilient component formed of thermoplastic elastomeric honeycomb material for absorbing projectile strike energy and reducing impact noise and/or blunt trauma injury. The armor component includes multiple layers of high tensile strength aramid fabric or the like sandwiched between front and back plates made of multiple layers of woven carbon cloth impregnated with an epoxy resin or the like. The several layers of the armor component are formed and compressed to provide a rigid outer shell that can advantageously be configured as planar or shaped to suit particular applications. The resilient component is affixed to the inside surface of the armor component and may include one or more layers of flexible honeycomb material having cells that are open, hermetically sealed, or perforated to provide fluid circulation therethrough.

19 Claims, 11 Drawing Sheets

LIGHTWEIGHT ARMOR AND BALLISTIC PROJECTILE DEFENSE APPARATUS

FIELD OF THE INVENTION

The present invention generally relates to armor materials and apparatus for resisting the ballistic forces of bullets and other projectiles, and more particularly, to an armor assembly and apparatus formed of layered formable materials configurable to provide a defensive covering or shield for protection of personnel, shelters and vehicles.

BACKGROUND OF THE INVENTION

In law enforcement and military environments it is often necessary and appropriate to use protective shields of various forms and configurations to protect personnel and equipment from injury or mechanical damage caused by projectiles including bullets, spall, shrapnel, etc. The shielding apparatus may be of a type that is worn as protective personnel body armor; a type that is used to provide protective panels for a land, sea or air vehicle; a type that may be configured to provide a shelter; or merely a collection of panels that can be affixed to a wall of a shelter to prevent penetration thereof. In these applications, it is usually desirable that the shielding apparatus be made of material that is strong, light and thin; and in the case of body armor, it should also be capable of dispersing or otherwise dealing with body heat and perspiration.

While means for opposing a particular type of ballistic threat can usually be designed and/or configured for inclusion in original equipment, the provision of easily retro-fittable and/or transportable armor materials is more difficult in that it must usually have characteristics such as formability, relative lightness in weight, durability in hostile environments, and other particular attributes such as having the capability of deflecting or capturing incoming projectiles.

Bullet-proof vests are a form of personal body armor that either deflects or absorbs the impact of gun-fired projectiles and explosive fragments fired at the torso of its wearer. Soft vests made from layers of tightly-woven fibers are intended to protect the wearer from projectiles fired from handguns, shotguns, and shrapnel from explosives such as hand grenades and improvised explosive devices (IUDs). Soft vests are usually made of flexible aramid fibers and have long been worn by police forces and private security guards.

Soft vests per se do not protect the wearer by deflecting bullets. Instead, the layers of high tensile strength material forming the vest are intended to catch the projectile and spread its force over a larger portion of the wear's body, and hopefully bring the projectile to a stop before it can penetrate into the body. This tends to deform the bullet, further reducing its ability to penetrate. However, while a vest can prevent invasive bullet wounds, the wearer's body must still absorb the bullet's energy, and can often incur blunt force trauma in which a majority of users experience only bruising; but impacts can still cause severe internal injuries.

Another problem with soft vests is that they offer little protection against arrows, ice picks, stabbing knife blows, bullets with their points sharpened, and armor-piercing rounds because the striking force is concentrated in a relatively small area and can often push or be pushed through the weave of bullet-resistant fabrics. Accordingly, vests designed specifically to protect against bladed weapons and sharp objects are used by prison guards and other law enforcement officers.

Also, since soft body armor vests are usually ineffective against most military rifle rounds, some such vests may be augmented with metal, ceramic or polyethylene plates that are carried in pockets included in the vest to provide extra protection to vital areas. Hard-plate carrying vests are worn by armed response police forces as well as combat soldiers in the armies of various nations. These plate carrying vests have proven effective against bullets fired from most handguns and a range of rifles, and have become standard in military use.

However, these plated vests still have shortcomings because the energy of large fragments or high velocity bullets hitting some types of plates can still cause life-threatening, blunt trauma injuries. In an attempt to solve this problem, heavier ceramic and steel armor plates have been added to stop rifle caliber rounds. Unfortunately, because of the weight, such vests are often discarded and the soldier is left unprotected. In addition, since the plates often merely deflect the projectile or its resulting spall, it is not unusual for a wearer to survive the initial impact only to receive substantial and even lift threatening injury as the deflected material strikes another part of his body. For example, many plated vest wearers have received devastating injury to their face, arms or head as a result of bullet spall deflected from the surface of a vest carried hard armor plate.

As protective personnel armor of various types and configurations has evolved, attempts at developing thin, light, less insulating, flexible and breathable protective materials have been made in order to create garments that are more wearable by the user. However, to maintain a level of protection in soft vests against higher caliber pistols and firearms it is still necessary that many layers of ballistic resistant fabric be used in combination with some type of rigid metallic or ceramic insert. Unfortunately, this increases the overall weight and thickness of the garment and reduces its flexibility.

It is recognized as desirable that a protective body armor garment cover as much of the wearer's body as possible while at the same time maintaining wear-ability. Thus, the thinner and lighter the protective article, the more feasible it is to increase body coverage. Moreover, conceal-ability of the anti-ballistic body armor can be improved if it can be constructed to be thin and non-bulky. Thin and lightweight armor can also allow increased mobility so that those wearing the article are not hampered from doing their job.

In the last few decades, several new fibers and construction methods for bulletproof fabric have been developed including woven Dyneema, GoldFlex, Spectra, Twaron, and Zylon. Although Kevlar has long been used, some of the newer materials are said to be lighter, thinner and more resistant than Kevlar, but are considerably more expensive. But even so, the expense is justified because the more lightweight, thin and less insulating a protective ballistic resistant garment is made, the more likely an intended user (such as a law enforcement officer or military personnel) will actually wear the garment, especially in the case of hostile environmental conditions and long working shifts.

Reduction of weight and improvements in thinness of materials have been made by the utilization of stitched together layers of sheets of these woven materials. For example, high tensile strength aramid fibers such as Kevlar® have often been employed in forming the woven ballistic fabric. Other aramids such as Twaron.®T-1000 and Twaron.®T-2000 have also been used in forming woven sheets of material used in ballistic resistant pads. Dyneema and Spectra are synthetic fibers based on ultra high molecular weight polyethylene which has yield strengths as high as 2.4 GPa and density as low as 0.97 Kg/l (for Dyneema SK75).

This gives a strength/weight ratio as much as 15 times stronger than steel and up to 40% stronger than Aramids.

In the case of body armor, various voluntary governmental ballistic standards have been established to certify certain ballistic resistant garments. The tests determine the ability of the garment to resist penetration from various ballistic rounds shot from various types of weapons. In particular, the National Institute of Justice (NIJ) Standard 0101.03 certification tests are frequently used in testing certain body armor products. These tests are grouped into different threat levels, with each threat level corresponding to ballistic projectile penetration stopping capabilities of various ballistic rounds fired from designated weapons. For generally concealable type ballistic resistant body armor, NIJ Standard certification tests are often performed for NIJ Threat Levels IIA, II and IIIA. Threat Level IIIA is a higher standard level than Threat Level II which in turn is a higher standard level than Threat Level IIA.

There is thus a continuing need to provide improved armor materials that are thin and lightweight, have the ability to capture rather than reflect projectiles, bullet spall and the like, and in the case of body armor have good insulating and/or heat application or removal properties to increase their wearability while still meeting industry standards for armor materials.

SUMMARY OF THE INVENTION

It is therefore an object of the present invention to provide ballistic resistant armor which is lightweight and of high strength.

Another object of the present invention is to provide armor materials and apparatus of the type described which can be molded to conform to various shape and contours.

Another object of the present invention is to provide armor materials and apparatus of the type described which have the ability to capture rather than reflect bullet spall and the like.

Yet another object of the present invention is to provide armor materials and assemblies that reduce the sonic energy transmitted therethrough upon impact by a bullet or other object;

Still another object of the present invention is to provide a ballistic resistant armor assembly having means for suppressing the likelihood of blunt trauma injury.

A further object of the present invention is to provide ballistic resistant body armor apparatus of the type described which permits fluid circulation therethrough to add or reduce heat to/from the body of a user.

A still further object of the present invention is to provide a material and apparatus of the type described which can be used to protect personnel operating in hostile environments Briefly, in accordance with an embodiment of the present invention, and as described in detail below, the above mentioned objectives are met by a new ballistic resistant armor material and assembly including a thin rigid armor component for stopping and capturing ballistic projectiles, backed by a resilient component formed of thermoplastic elastomeric honeycomb material for absorbing projectile strike energy and reducing impact noise and/or blunt trauma injury. The armor component includes multiple layers of high tensile strength aramid fabric or the like sandwiched between front and back plates made of multiple layers of woven carbon cloth impregnated with an epoxy resin or the like. The several layers of the armor component are formed and compressed to provide a rigid outer shell that can advantageously be configured as planar or shaped to suit particular applications. The resilient component is affixed to the inside surface of the armor component and may include one or more layers of flexible honeycomb material having cells that are open, hermetically sealed, or perforated to provide fluid circulation therethrough. Alternatively, multiple combinations of the rigid armor component and resilient component may be included in the assembly.

An important advantage of the present invention is that it provides an extremely lightweight armor structure that can be formed to mate with any contour of an object or body to be protected.

Another advantage of the present invention is that it provides a lightweight armor structure that can be formed to at least partially envelope parts of a wearer body to be protected.

Still another advantage of the present invention is that it provides a lightweight armor structure having means to permit warming or cooling fluid flow therethrough.

Yet another advantage of the present invention is that it provides a multilayered assembly having a hardened outer component that can be used to make armor in planar as well as shaped or contoured form.

A still further advantage of the present invention is that it provides an assembly that can be used to provide armor for vehicles, shelters or personnel.

An additional advantage of the present invention is that it can be configured to provide threat protection meeting various governmental standards.

These and other objects and advantages of the present invention will no doubt become apparent to those of ordinary skill in the art after having read the following detailed description of the several embodiments illustrated in the drawing.

DETAILED DESCRIPTION OF EMBODIMENTS

Figure 1:
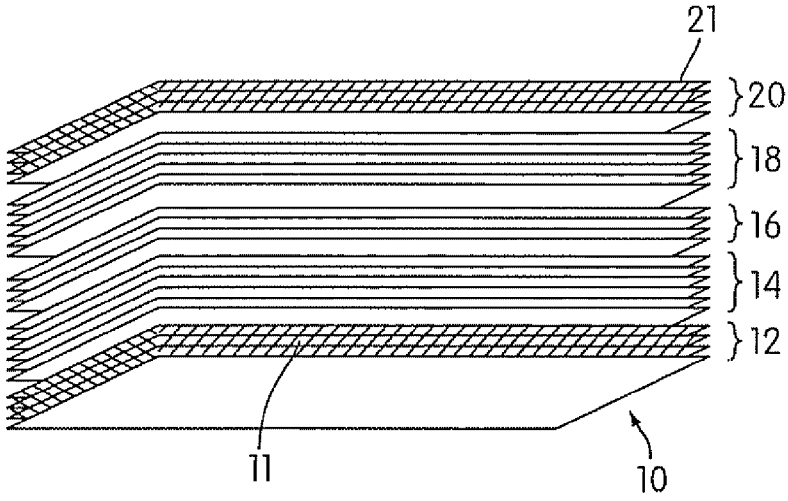
FIG. 1 is a perspective view showing a buildup of layers of fabric to provide a rigid armor component in accordance with the present invention.

Referring now to FIG. 1 of the drawing, an illustration is provided showing at 10 a stack of fabric layers of high strength woven or non-woven sheet material including five subsets of layers 12-20 in accordance with one embodiment of the present invention. As depicted, the first subset 12 includes 4 plys of woven carbon fiber cloth; the second subset 14 includes 6 plys of Kevlar 29® woven fabric made by E. I. du Pont de Nemours and Company; the third subset 16 includes 4 plys of carbon fiber cloth of the same type used in subset 12; the fourth subset 18 includes 6 plys of Kevlar 29® woven fabric of the same type used in subset 14; and the subset 20 includes 4 plys of carbon fiber cloth of the same type used in subset 12. As suggested by the hatching at 11 and 21, the carbon cloth layers of subsets 12 and 20 (and possibly subset 16) are impregnated with an epoxy resin so that when compressed and cured the form rigid front and back shells for the armor component. The layers forming subsets 14, 16 and 18 may or may not be impregnated with resin, polyurethane or other bonding material as will be further described below.

Figure 2:
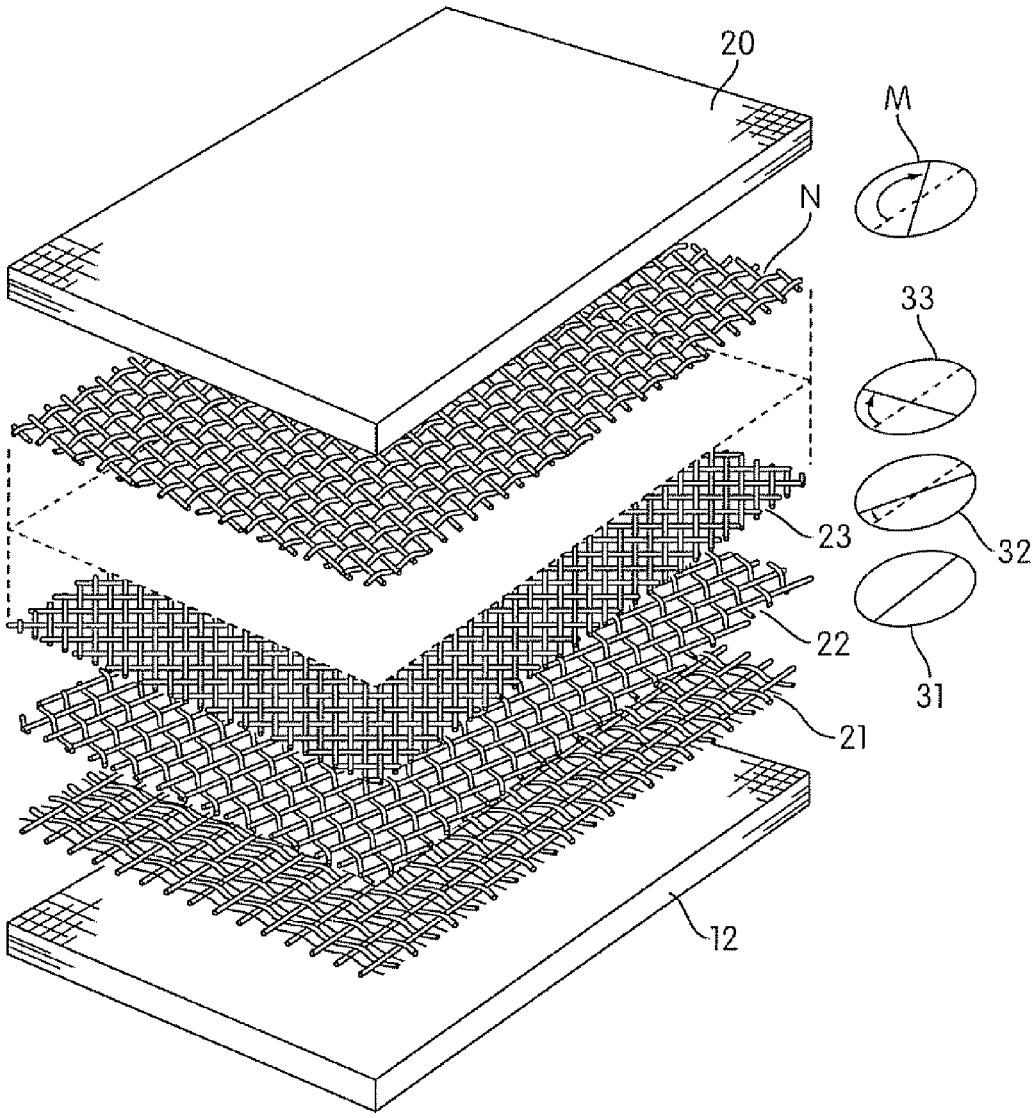
FIG. 2 is an exploded perspective view showing rotation of fabric layers in the buildup of layers depicted in FIG. 1 in accordance with the present invention.

As illustrated in FIG. 2, the upper and lower subsets 12 and 20 may be pre-assembled and compressed, or thermo-compressed prior to assembly with the fabric layers of subsets 14-18. In such case, the pre-assembled resin impregnated carbon sheet sub-assemblies 12 and 20 can be treated like single layers of rigid sheet or shaped material during a subsequent lay-up process as depicted. Alternatively, the several resin impregnated carbon sheets may simply be included in a sheet-wise lay-up assembly process. In either case, and as illustrated in this figure, each layer of at least the interior subsets 14-18 is preferably rotated in plane relative to its adjacent layer so that its warp and weft are rotationally displaced by a predetermined angle relative to the warp and weft of its neighboring layers. A similar rotation of the carbon sheets in subsets 12 and 20 can also be implemented.

More specifically, as depicted in FIG. 2, several sheets of woven fabric are schematically shown at 21, 22, 23, . . . n, along with corresponding rotation diagrams 31, 32, 33, . . . m to illustrate how the several plys are rotated relative to each other in accordance with one embodiment of the invention. In the rotation diagrams the solid diameters correspond to the warp of the related fabric sheet, while the dashed diameters correspond to the warp direction of sheet 21.

The rotation of the several layers in the preferred embodiment is at about 30 degrees per layer, as suggested by the rotation diagrams 31-*m*, so that advantage of the tensile strength of the fibers in the several layers is assured in all directions in the interior "plane" of the resulting armor plate. However, it is anticipated that for some applications it may be desirable to rotate the sheets in other patterns as well. For example, it may be useful to rotate 2 or more adjacent sheets together; or to rotate only every other sheet; or otherwise change the angles of sheet rotation across the thickness of the stack in accordance with some reasoned plan. Further discussion of the reason for rotating the sheets will be made below with respect to FIGS. 5 and 6.

If the interior layers of fabric are of a type that is subject to degradation in the presence of water or moisture, such as is Kevlar®, it may be desirable to impregnate these layers, or at least the perimeters of the layers, with a material such as polyurethane to seal them against moisture penetration. However, in some cases where the impregnated carbon fiber layers of subsets 12 and 20 are built-up in situ along with the other layers, it may be that the impregnating material in the outer layers will be caused during the thermo-forming process to invade the fibers of the interior layers of subsets 14-18 and not only seal them against moisture penetration but also fix them in their compressed disposition after the forming operation is completed.

Note that as suggested above, an interior subset 16 of carbon fiber layers may be sandwiched between the two subsets 14 and 18 of Kevlar® material. The reason for these layers will be discussed below.

Figure 3:
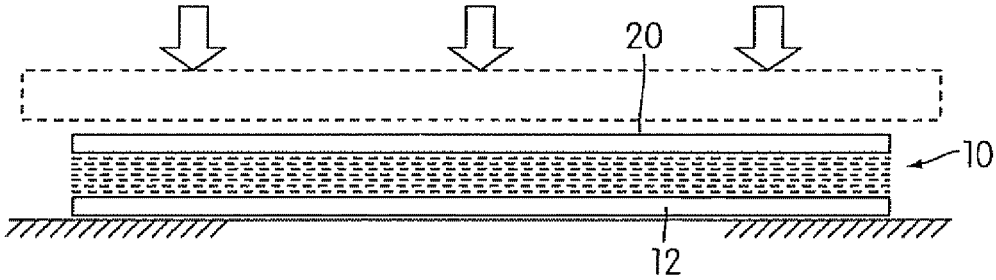
FIG. 3 is a diagram illustrating thermo-compression of the layer stack illustrated in the preceding figures.

Once the stack 10 is so assembled, it is preferably subjected to heat and compression forces as suggested in FIG. 3 and compressed to a thickness of less than 0.25 inch. In a preferred embodiment the resulting thickness is about 0.185 inch. The compression of the stack will result in an armor plate having an extremely hard outer surface on both front and back faces. If the inner layers 21-*n* disposed therebetween are not impregnated with polyurethane or other suitable bonding material, the resin in the outer carbon layers will, during the thermo-compression process, migrate to some extent through the fabric of the non-impregnated layers. Accordingly, the internal layers will also be fused together, but to a lesser extent than the outer layers. As a consequence, the resulting composite structure will have the apparent characteristics of a unitary armor plate even though the interior layers may be relatively loosely bonded together. Accordingly, as further described below, on impact by a bullet or other projectile, the fibers of the interior layers will function such that the benefits of their high tensile strength can be advantageously utilized.

Figure 4:
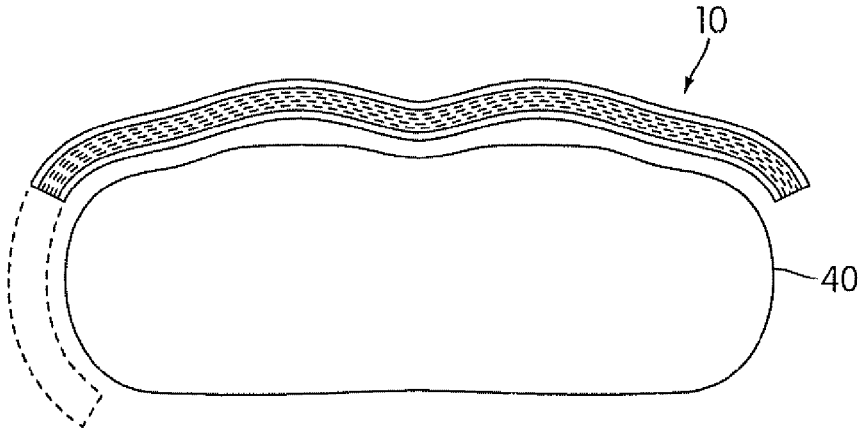
FIG. 4 is a diagram illustrating how a layer stack can alternatively be formed in accordance with the present invention.

It will be appreciated that before thermo-compression, the pre-compressed layer stack is laminar and the several layers may not be firmly affixed to each other. Accordingly, the layers can shift somewhat relative to each other and, notwithstanding the high tensile strength of each layer, the assembly can advantageously be wrapped or "molded" over a three dimensional surface during the forming operation and thus be caused to assume a predetermined final shape that can be other than planar. More specifically, as illustrated in the cross-sectional view of FIG. 4, the layer stack 10 can be formed over an anvil 40 configured to replicate a particular shape; for example, a human arm, torso, or other body part, or any other surface of an object or body to be protected.

It will also be appreciated that the several layers of material may also be formed to a 3-dimensional surface by simply impregnating the layers as described above, draping each layer in sequence over the forming surface, and then compressing the assembled stack over the mold by either pressing a mating form thereover or using a vacuum forming or other process to force the several layers together.

Figure 5A:
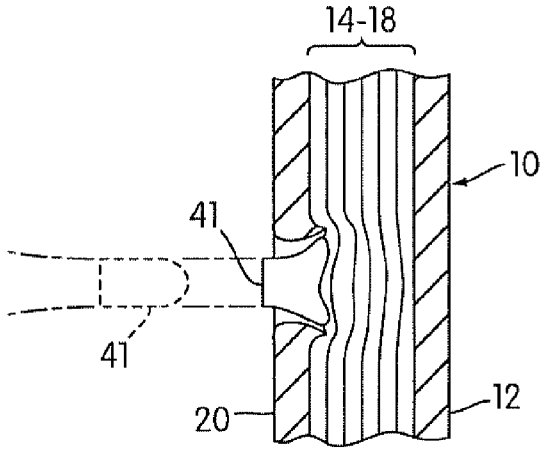
FIG. 5 is a three-part cross sectional view generally illustrating operation of an armor component of an embodiment in accordance with the present invention.
Figure 6A:
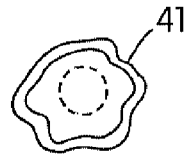
FIG. 6 is a three-part view corresponding to FIG. 5 and further illustrating in schematic form operation of the present invention.
Figure 5B:
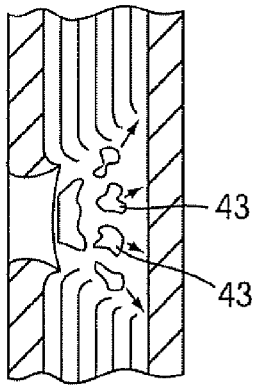
Figure 6B:
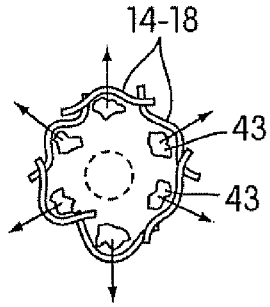
Figure 5C:
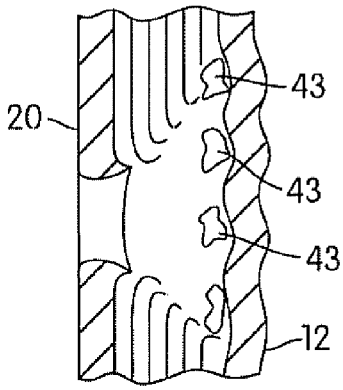
Figure 6C:
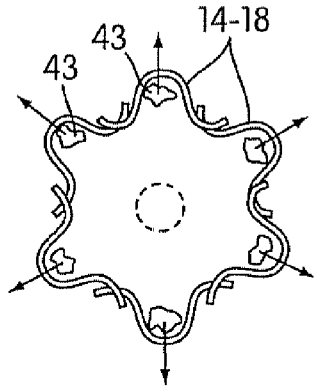

In FIG. 5, a three-part cross sectional representation of a portion of the previously described armor plate 10 is presented schematically illustrating the function of the plate as it is struck by a bullet 41. FIG. 6 is a corresponding three-part axial view of the on-coming projectile schematically illustrating the deformation and disintegration of the bullet as it strikes and passes into the plate 10.

As depicted in part a) of FIGS. 5 and 6 it will be noted that as the bullet strikes the hard carbon layer 20 it starts to flatten and spread outwardly from its axis of flight as it passes through the shell.

As depicted in parts b), the bullet has begun to disintegrate, and the pieces thereof (spall 43) continue to move forwardly and outwardly from the axis of flight, engaging and being restrained by the fibers of the fabric layers 14-18. Since the warp and weft of the several layers of fabric extend in various directions across the flight path of the bullet, the particles of spall 43 which might otherwise continue radially outwardly will engage and be resisted by the strands of the fabric which tend to be stretched in their strongest (longitudinal) direction. By having rotated each layer of fabric, it is insured that no particle of spall finds an unobstructed path through the weave of the several layers of fabric.

As illustrated in part c) of FIG. 5, tests have indicated that as the spall reaches the rear side of the plate 10 it may still have enough unexpended energy to deform the hard carbon shell 12, but the impact energy will be spread over an area substantially larger than the transverse cross sectional area of the incoming projectile. As will be described below, an energy absorbing panel is affixed to the back surface to further absorb the impact energy, reduce impact noise and militate against blunt trauma injury to a wearer of an armor assembly provided in accordance with the present invention. In tests, a prototype of this plate has successfully stopped and completely captured a .45 caliber blunt nosed bullet fired from less than 20 feet away.

It will be recalled that in the embodiment described in FIG. 1 above, several layers of carbon fiber cloth (16) were sandwiched between the subsets 14 and 18 of Kevlar® fabric. Since carbon fibers are good conductors of heat, the purpose of these several sheets of carbon fabric is to spread the heat generated by the bullet as it disintegrates. Although not necessarily an essential part of the stack, it is believed to improve the performance thereof.

Figure 7:
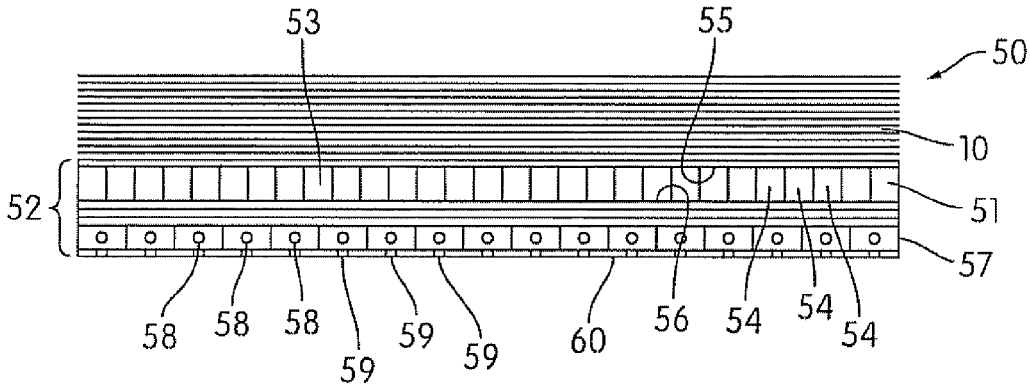
FIG. 7 is a cross sectional view generally illustrating an armor assembly in accordance with the present invention.

Having once formed the layered armor component or plate 10, an armor unit in accordance with an embodiment of the present invention, and as illustrated in cross section at 50 in FIG. 7, can be completed by bonding or otherwise affixing a resilient component 52 to the armor plate 50 for cushioning, dampening and otherwise resisting the impact energy applied to the plate 10 and transmitted to component 52 as the incoming ballistic implement is captured.

In a preferred embodiment the resilient component 52 includes a closed cell anisotropically flexing honeycomb panel 51 made of thermoplastic polyurethane material of the type described in my U.S. Pat. Nos. 5,039,567; 5,180,619; 5,444,881; 5,496,610; 5,534,343; and 5,617,595, the disclosures of which are expressly incorporated hereinto by reference.

The panel 51 preferably includes a honeycomb core 53 which is made from a stack of strips or ribbons of an appropriately selected grade of thermoplastic elastomeric material. The ribbons are thermal compression bonded together at spaced intervals staggered between alternate strips such that when the bonded stack is expanded, this pattern of bonding results in a honeycomb of generally hexagonally or rectangularly shaped (depending on the degree of expansion) cells 55. The honeycomb core 51 is tear-resistant and resilient, yet extremely light weight, and is approximately 90 percent air. Furthermore, it is substanyially lighter than the foams normally used as energy absorbing media in prior art ballistic resistant shields. The core manufacturing and fabrication process is described in greater detail in my prior U.S. Pat. No. 5,039,567 mentioned above.

Figure 8:
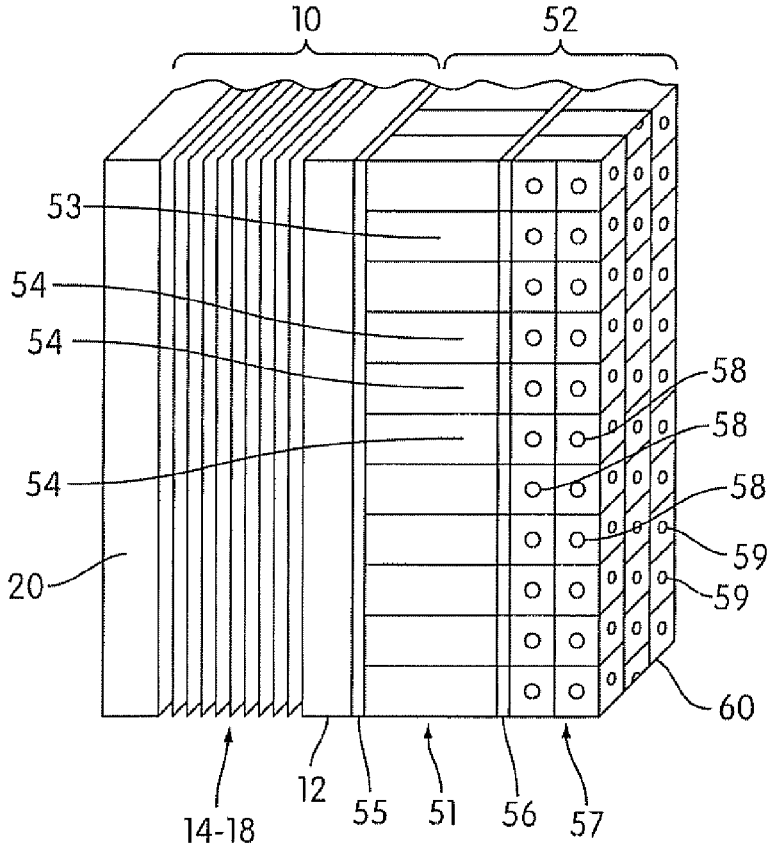
FIG. 8 is a perspective view generally illustrating a partial section of the embodiment illustrated in FIG. 7.

A first facing sheet 55 is thermal compression bonded to the upper face of the core 51 (as further illustrated in FIG. 8). A second facing sheet 56 is likewise thermal compression bonded to the lower face of the core. Typically, the facing sheets are made from the same material as the core, but can be made of any suitable material. The primary purpose of the honeycomb panel is to absorb the energy remaining after the armor plate 10 has stoped a projectile; it also serves a secondary purpose of dampening sonic energy transmitted through the armor component. A resilient panel made of a honeycomb material is generally substantially lighter and more flexible than other cushioning materials, yet is fully capable of absorbing energy transmitted thereto and mitigating the likelihood of blunt trauma injury. Another important quality of the honeycomb panel 51 is that it is an anisotropic three-dimensional structure which has varying degrees of flex in its width, length, and thickness dimensions.

Selected combinations of elastomeric material and modulus, honeycomb cell configuration, and core thickness variables will determine the softness or hardness, dampening characteristics, and rigidity or flex of the panel as required for a particular application. By selection and combination of the ribbons of material that make up the core, or by varying the core dimensions and cell sizes, the flexibility of the resulting core can be predetermined. For example, the core can be made to have a greater stiffness (and lesser flexibility) in one area, and a lesser stiffness (and greater flexibility) in another area of the panel.

The facing and core materials can be selected from a wide variety of films, including blends such as urethane/poly-carbonates, spun-bonded thermoplastics such as polyethylene or polypropylene polyester, thermoplastic urethanes, elastomeric or rubber materials, elastomer impregnated fibers and various fabrics, etc., or combinations thereof.

Figure 9:
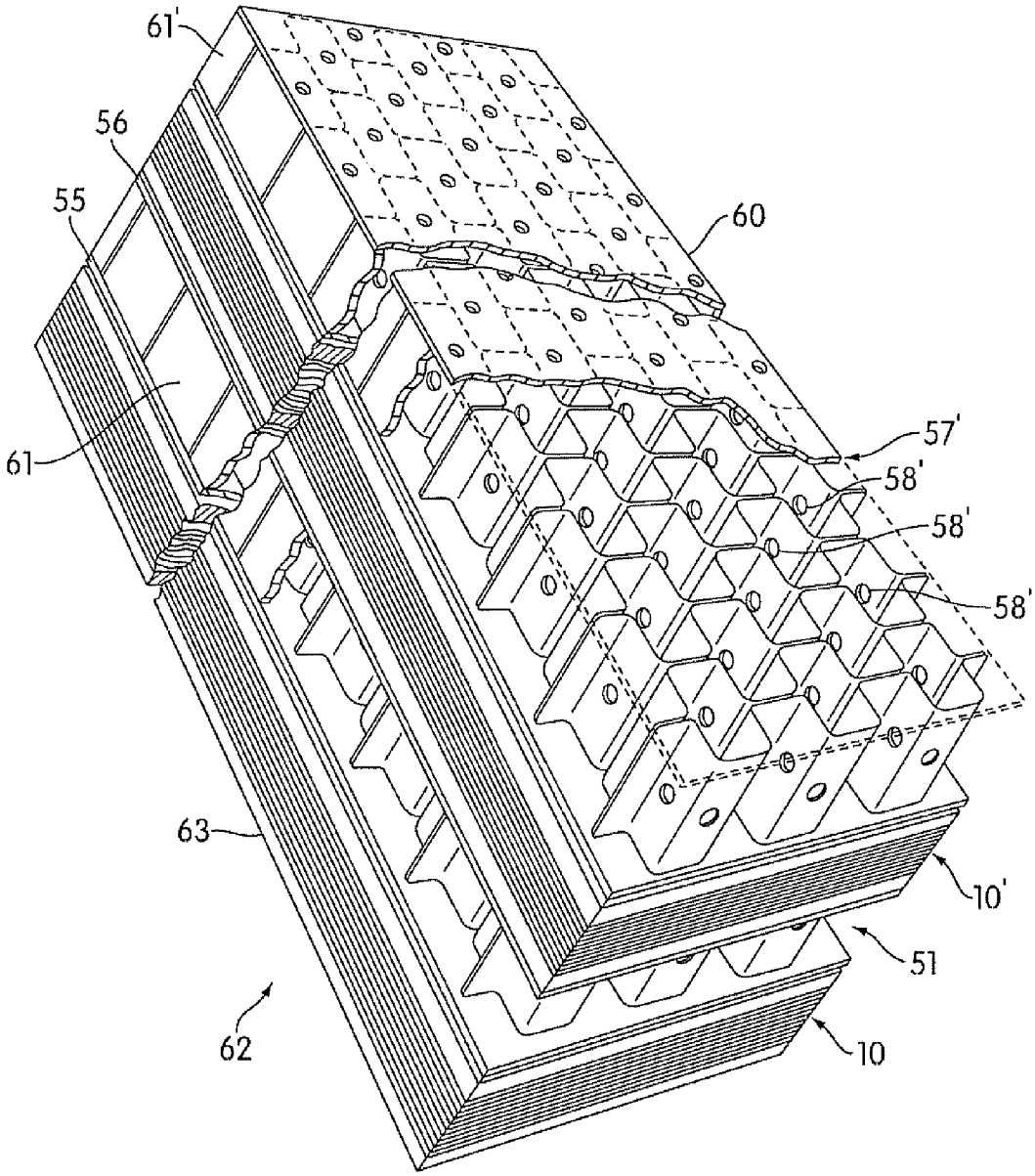
FIG. 9 is a perspective view generally illustrating an alternative embodiment of an armor assembly in accordance with the present invention.

In addition to the shock absorbing, closed cell panel 51, a ventilating pad 57 comprised of one or more resilient panels of apertured, anisotropically flexing honeycomb made of thermoplastic polyurethane material, or the like, perhaps of types like those disclosed in various ones of my above referenced prior patents, can be utilized for allowing air or other fluids to circulate, or be caused to flow therethrough, to remove heat from the body of a user. Furthermore, if the lower facing sheet is also apertured or perforated, perspiration can be removed from the clothing or body of the user. For example, as illustrated in FIGS. 7, 8 and 9, one or more apertures 58 are provided in the sidewalls of the honeycomb cells to allow cell-to-cell communication of fluids. Apertures 59 may also be provided in the lower facing sheet 60 to permit perspiration to be extracted from the user's clothing or skin, and transported through the cells to a discharge port (not shown).

Referring specifically to FIG. 9, an alternative embodiment is illustrated in partially broken perspective at 62 and includes two armor panels 10 and 10' separated by a honeycomb panel 51. Further included is an apertured honeycomb panel 57' affixed to the back side of panel 10' and opposite the front face 63 of the assembly. As shown, all cells of the honeycomb panel 51 of this embodiment are closed by upper and lower facing sheets 55 and 56, and a sealing membrane 61 circumscribing the perimeter of the panel. This resilient honeycomb panel will provide substantial absorption of impact energy applied to the armor panel 10. In the event that a projectile or any part thereof should succeed in penetrating the first armor layer 10, its energy and momentum will have been so absorbed and expended that the likelihood of penetration of the second armor layer 10' is materially reduced and any impact force transmitted through panel 51 will be spread over a large area of the surface of layer 10'.

Furthermore, even if a projectile is successful in penetrating panel 10, there is a high probability that it will be captured by panel 10', and the likelihood or any blunt trauma injury to a person or apparatus on the back side of the assembly will be further reduced by the second honeycomb panel 57' even though its energy absorption characteristics may be substantially less than that of panel 51 due to its open cell or apertured cell configuration.

As will be further discussed below, if the assembly is configured as molded body armor, and the pad (panel) 57' is made quite flexible, normal movement of the wearer's body may apply compressive forces to the pad causing air to flow through the apertures 58 to provide a cooling action as the wearer moves about in his normal routine. In other applications, or in extremely hot environments, such as in a dessert setting, or in a closed vehicle or shelter, it may be desirable to couple a pump to the perforated panel to force a flow of fluid therethrough. Similarly, when used in a cold environment, heated air or other liquid or gas may also be passed through the apertured honeycomb panel to provide a warming function.

Figure 10:
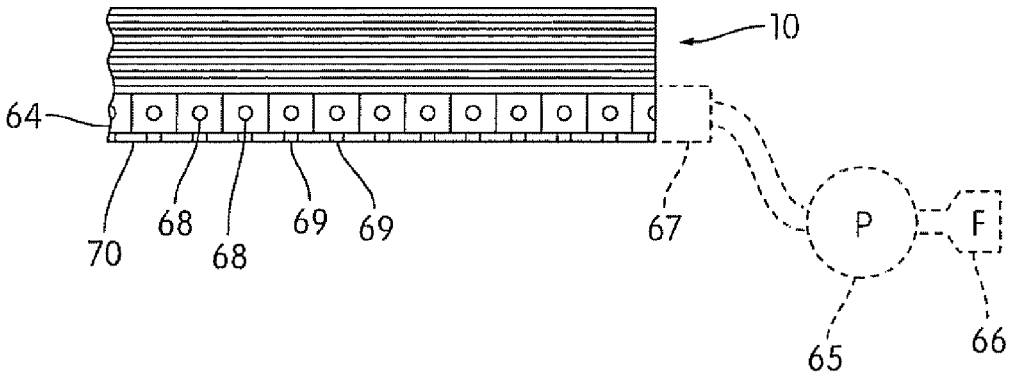
FIG. 10 is a cross sectional view generally illustrating another alternative embodiment of an armor assembly in accordance with the present invention.

In FIG. 10, an alternative embodiment of the present invention is schematically depicted that is suitable for use in those applications in which it is desired that the armor assembly include a single panel that serves both as a shock absorbing medium and as a cooling or heating means. In this case, a single apertured honeycomb panel 64 affixed to the back side of the armor plate 10 using suitable bonding materials can be used together with a pressurizing or evacuating pump 65 (and perhaps a suitable filter 66) that is connected to the panel via an appropriately configured flow directing or manifolding fixture 67. As described above, the size and configuration of the apertures 68 in the core walls 69 (and perhaps the facing sheet 70) (and perhaps also the fluid pressurization/evacuation level to be accomplished by the pump 65) must be matched to the resilience characteristics of the panel in order to insure that the desired levels of energy absorption and ventilation are simultaneously achieved.

Figure 11:
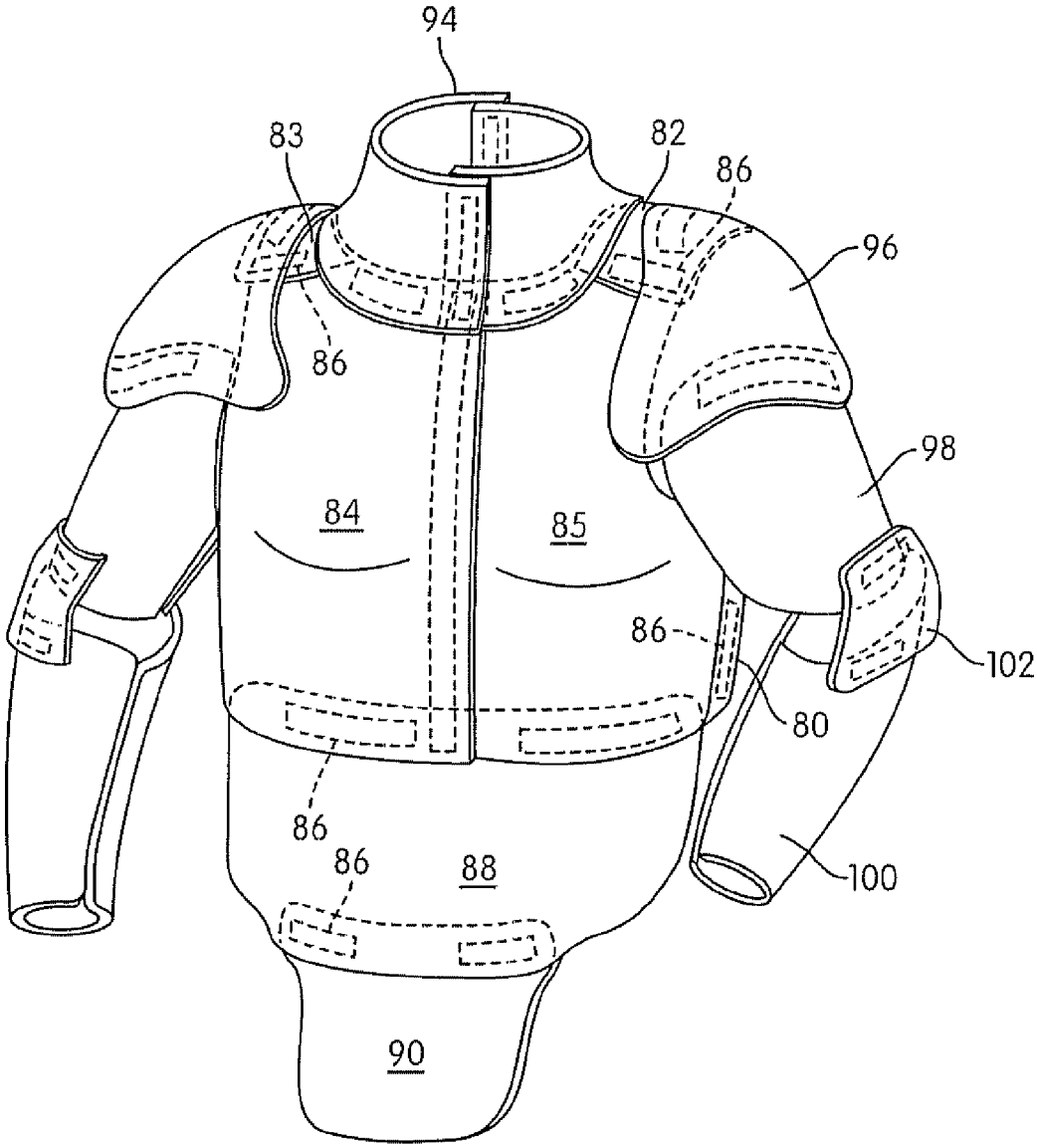
FIG. 11 is a pictorial view generally illustrating a body armor application in accordance with an embodiment of the present invention.

Referring now to FIG. 11, an example of an embodiment implementing the moldable (formable) characteristics of the present invention are illustrated in the form of a full upper-body armor suit made using the assembly described above. As shown, the suit includes a three-part vest assembly featuring a custom molded back panel 80 (partially shown) having upper projections 82 and 83 formed to extend over the shoulders of the wearer, and a pair of over-lapping breast panels 84 and 85 suspended from and attached to the back panel by suitable fasteners shown in dashed lines 86.

This assembly might also include a molded abdominal skirt 88 and groin panel 90 attached to the breast panels 84/85 by fasteners 86 so as to make sitting and "bowing" actions more convenient than would be the case if the entire length of the torso were covered with a single length of panel. A similar lumbar panel and skirt panel, or panels (not shown), might also be provided to cover the wears posterior. Furthermore, the armor might also include a two-piece neck protector 94, shoulder pieces 96, upper and lower arm pieces 98 and 100, and perhaps even a pair of elbow plates 102, all made of the above described hard armor material with or without full underside honeycomb padding as further described below.

Figure 11A:
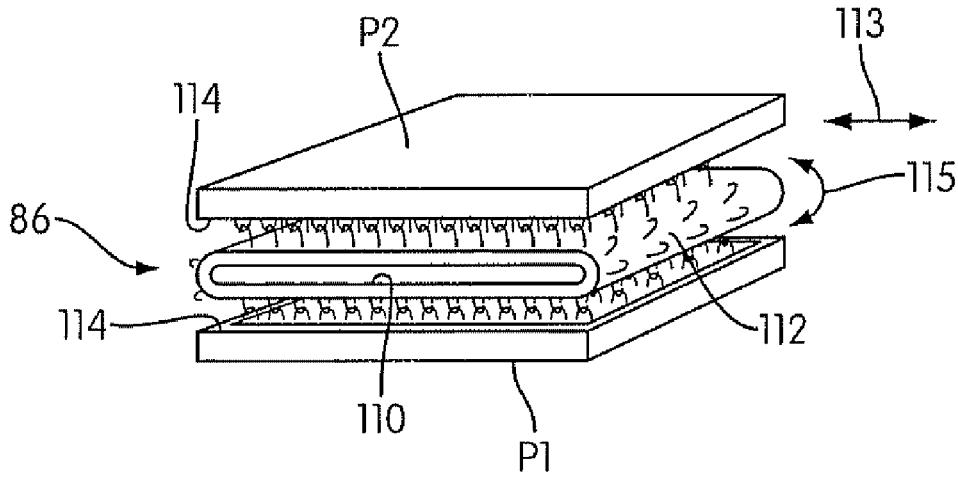
FIGS. 11*a* and 11*b* illustrate means for flexibly attaching armor panels of the type described to each other.
Figure 11B:
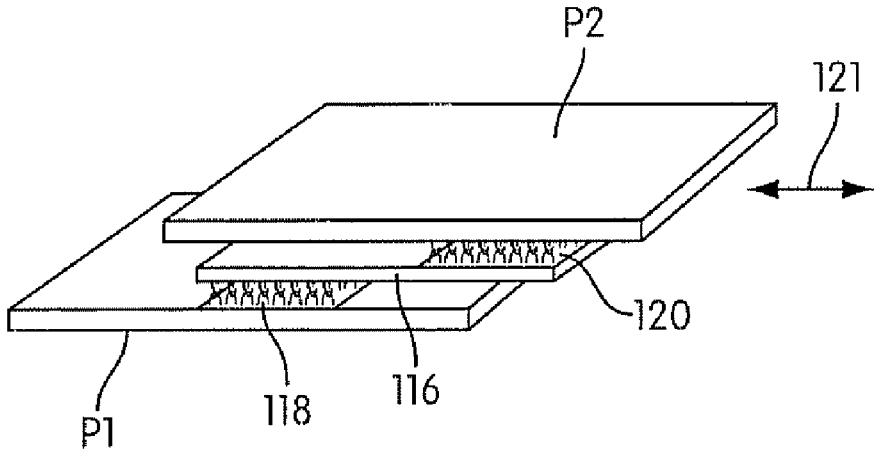

The fasteners 86 might include detachable means having an elastic or shearing characteristic which permits a degree of relative movement between attached panels to accommodate wearer body contortions. More specifically, as illustrated in FIG. 11*a*, the fasteners 86 might be formed of a tubular component 110 having Velcro-style hooks 112 provided on the outer face thereof for engaging strips 114 of Velcro-style looped material affixed to opposing faces of adjacent panels P1 and P2. When the panels are secured by means of such fasteners, should shearing motion between the panels be required as the wearer turns, stoops, sits, etc., limited relative motion of the panels, as suggested by the double-headed arrow 113, is accommodated as the tubular component "rolls" to and fro, as suggested by the double-headed arrow 115, while still securing the panels together.

A similar alternative means of fastening the panels P1 and P2 together might include an elastic strip 116 having one extremity affixed to the plate P1 by a first Velcro-type fastening combination 118, and the opposite extremity affixed to the plate P2 by a second fastening combination 120. As is suggested by the double-headed arrow 121, plate P2 can move to and fro relative to plate P1 as the elastic between the fasteners 118 and 120 stretches and contracts.

While it is possible that many other types of fasteners may be used to secure the several panels or plates together and still allow limited relative movement therebetween, an advantage of the use of the illustrated Velcro-like fasteners is that the user can quickly suit himself by donning each component part in sequence. Similarly, should it be necessary to quickly remove the armor, the wearer can simply pull each piece off.

Since the armor plate of the present invention is thin and light weight, and since the cushioning honeycomb padding can be applied only in the areas needed, it will be apparent that virtually every critical part of the anatomy can be protected without severely restricting the wearer's mobility. For example, in those areas where the panels overlap, there is no need to provide honeycomb padding on the overlapping part. This means that a doubling of the thickness of the assembly at an over lap is not necessary because the padding on the underlying panel provides the trauma protection.

It will also become apparent to those of skill in the art that all body covering parts of an armor "suit" need not be of the "hard" configuration described above. For example, areas on the undersides of the arms, or perhaps torso areas shielded by the arms, might be covered with strips of soft armor fabric of the type known in the prior art, or even be left uncovered or covered with ordinary fabric leaving such areas unprotected.

Figure 12:
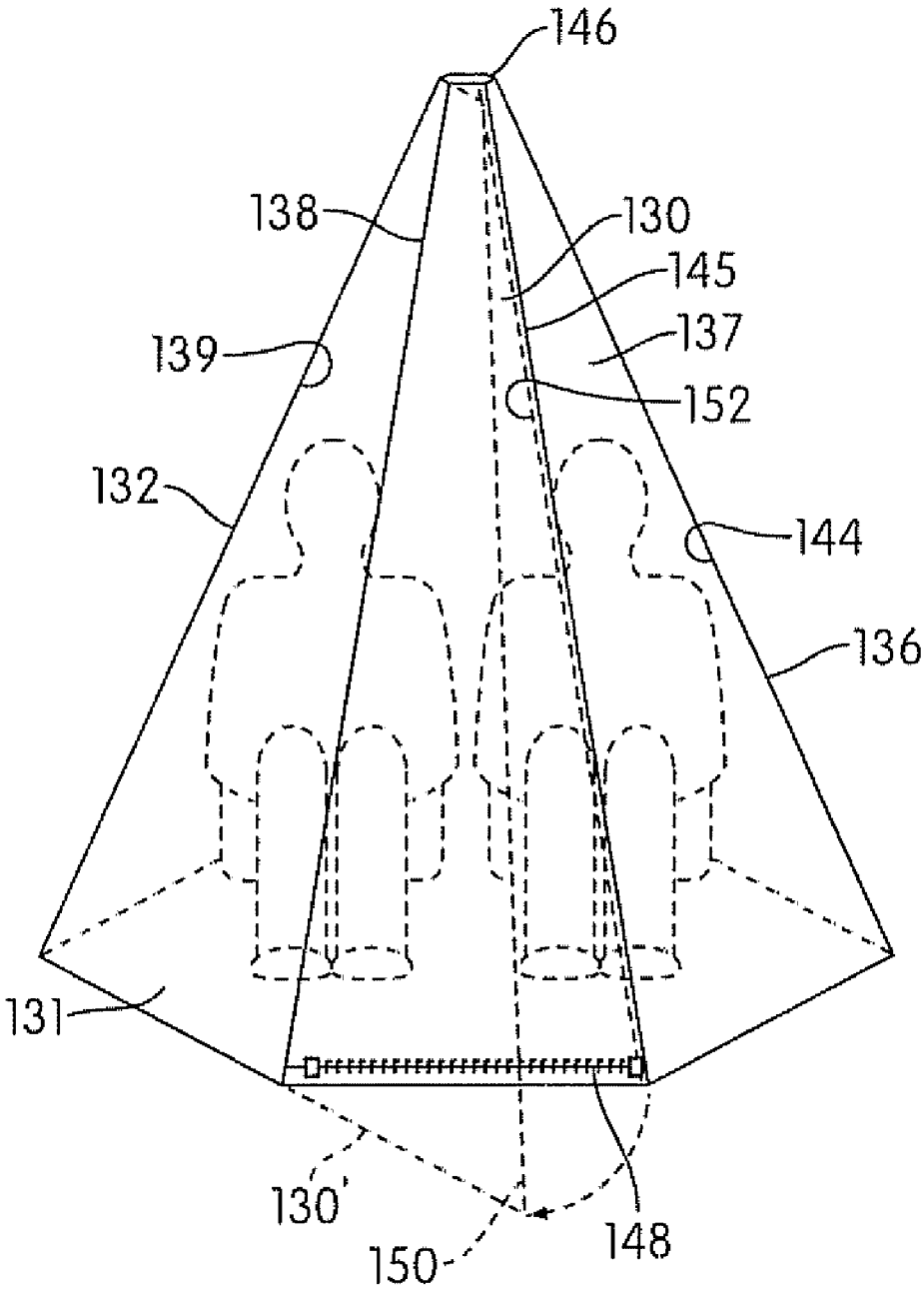
FIGS. 12-14 illustrate front, top and collapsed configurations of a protective shelter in accordance with the present invention.
Figure 13:
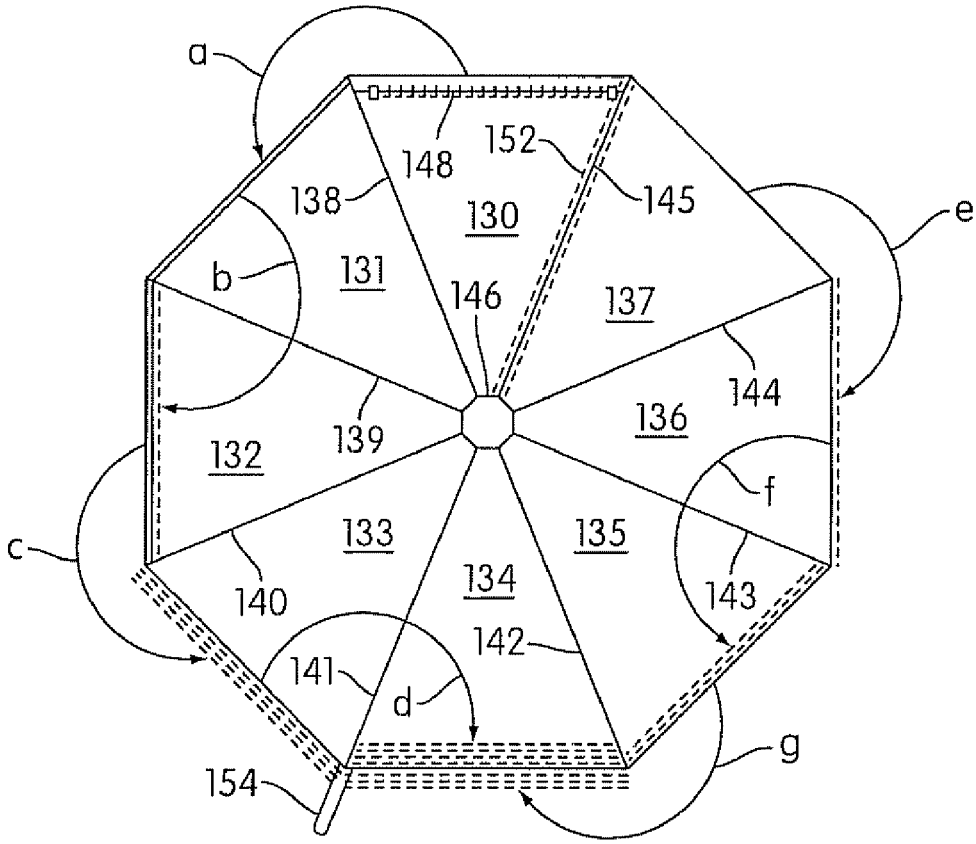
Figure 14:
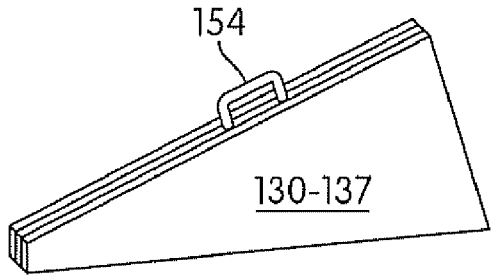

Turning now to FIGS. 12-14, an alternative use of the present invention is illustrated to provide a light-weight portable armored shelter of a type that might be used in appropriate settings. In this example, eight generally triangularly configured armor panels 130-137 are hinged together along their edges 138-144, such that when deployed, and secured together with a hook-latch 146 at the top and a chain and eyelets 148 at the bottom, as illustrated in side view in FIG. 12 and in top view in FIG. 13, the assembly forms a "teepee" like shelter that can easily shield one or two persons from bullets, shrapnel or other projectiles, fire, etc. When deployed, the panel 130 is hinged at 138 but is unattached along the edge 150 and forms a door though which persons can enter and sit or crouch as depicted. The door can then be closed and fastened to the open edge 145 of panel 137 by means of latches, a zipper, a strip of Velcro 152 or the like.

When protection is no longer needed, the deployed shelter can be quickly dismantled by unlatching the door 130, hook-latch 146 and chain 148, and by folding the panels back upon each other in the sequence and directions indicated by the arrows a-g, and into a carrying configuration illustrated ai FIG. 14. Note that a carrying handle 154 is affixed along the hinge line 141 so that the folded panels can easily be carried.

Depending on the application, the panels 130-137 can be comprised of armor plate without the honeycomb layer(s), or can include an inside lining of honeycomb or the like as described above to provide sound and/or thermal insulation. For example, in one embodiment, the lining might be intended to serve as a sound dampening means, or as a thermal insulating medium or both.

Those skilled in the art will appreciate that the structural strength, rigidity, flame resistant characteristics and thermal insulating properties of such a structure will allow it to be used as a temporary personnel shelter suitable for emergency use in many situations. For example, in one application, the shelter might be used in emergency situations by soldiers under fire in desert areas where there are no natural barriers to hide behind while awaiting assistance. In another application, this or a similarly configured shelter might be used by firefighters when caught in a burning building unexpectedly collapsing around them, or by forest fighters who have been caught by a reversing fire front, etc.

Figure 15:
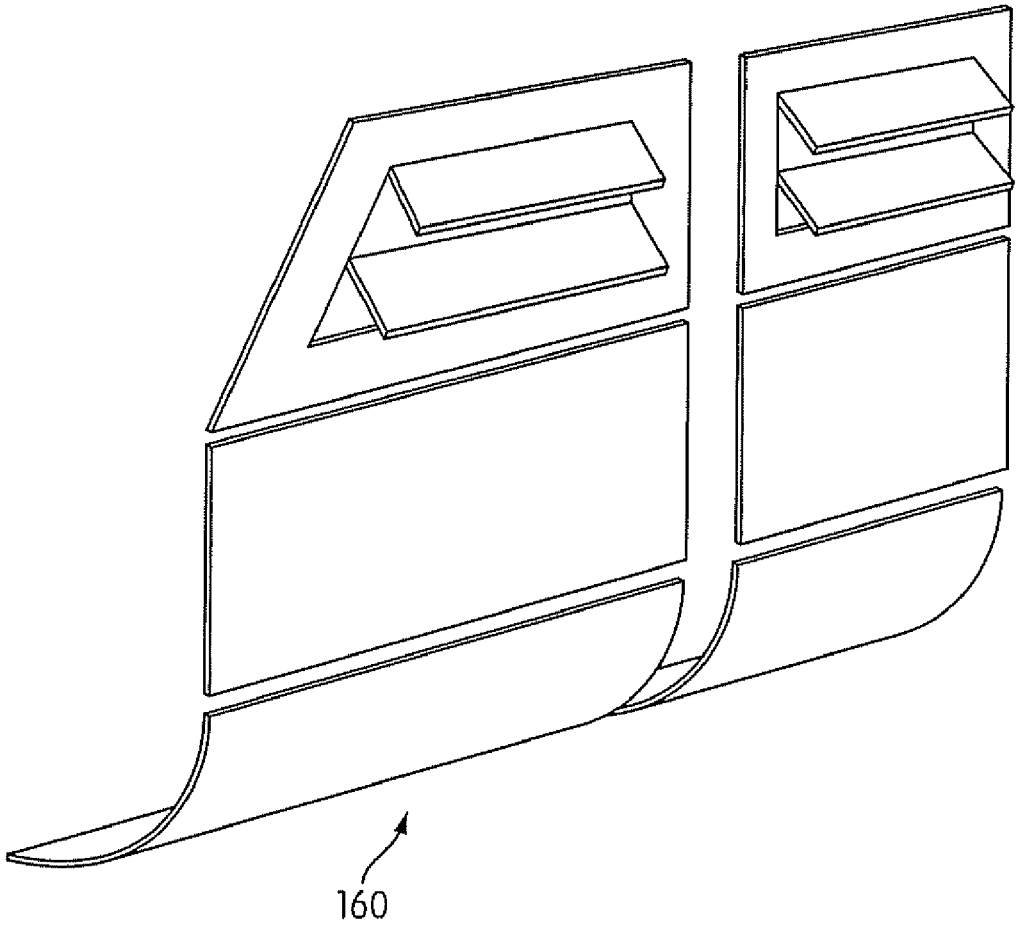
FIG. 15 is a perspective view illustrating armored side panels for a vehicle in accordance with the present invention.

Another application of the present invention is to provide protective panels for air, land or sea vehicles. For example, as depicted at 160 in FIG. 15, light weight armor panels made in accordance with the present invention can be configured and appropriately shaped for attachment to the sides, top and/or bottom of a vehicle to provide temporary or permanent shielding for, or to increase the shielding of, a military or law enforcement vehicle.

Although the present invention has been described above in terms of several alternative embodiments, and various applications have been suggested, it is anticipated that after reading the foregoing disclosure, numerous other embodiments and applications of the present invention will become apparent to those skilled art. It is therefore intended that this disclosure be considered as exemplary rather than limiting, and that the following claims be interpreted as covering all alternatives, modifications and embodiments as fall within the true spirit and scope of the invention.

The invention claimed is:

1. An armor panel comprising:

a rigid armor component having an outer face and an inner face and including a first laminated arrangement including a plurality of layers of carbon fiber cloth impregnated with a thermo-setting resin, a second laminated arrangement including a plurality of layers of aramid fabric, and a third laminated arrangement including a plurality of layers of carbon fiber cloth impregnated with a thermo-setting resin, said first, second and third laminated arrangements being thermo compressed to form said armor component; and a resilient component affixed to the inner face of said armor component and including at least one panel of thermoplastic elastomeric honeycomb material, said armor component being operable to resist impact form a projectile, and said resilient component being operative to absorb impact energy transmitted thereto from said armor component.

2. An armor panel as recited in claim 1 wherein said armor component further includes at least one layer of carbon fiber cloth sandwiched between layers of said plurality of layers of aramid fabric.

3. An armor panel as recited in claim 1 wherein at least some of the layers of said plurality of layers of aramid fabric are rotated relative to at least some of the other layers such that the warp and weft of at least some of the respective layers are angularly oriented relative to the warp and weft of at least some of the other layers.

4. An armor panel as recited in claim 1 wherein said first and third laminated arrangements each include at least three layers of resin impregnated carbon fiber cloth.

5. An armor panel as recited in claim 4 wherein said second laminated arrangement includes at least ten layers of aramid fabric.

6. An armor panel as recited in claim 4 wherein said second laminated arrangement includes at least three layers of carbon fiber cloth sandwiched between two groups of at least five layers of aramid fabric.

7. An armor panel as recited in claim 1 wherein said panel of thermoplastic elastomeric honeycomb material includes a honeycomb core sandwiched between and bonded to two facing sheets of thermoplastic elastomeric material.

8. An armor panel as recited in claim 7 wherein the walls of said honeycomb core have apertures formed therein so that fluid can flow through the cells thereof.

9. An armor panel as recited in claim 8 wherein one of said facing sheets is affixed to the inner face of said armor component and the other facing sheet is apertured such that fluid can flow through said panel of thermoplastic elastomeric honeycomb material via the apertures in said core and the apertures in said other facing sheet.

10. An armor panel as recited in claim 8 and further comprising means coupled to said panel of thermoplastic elastomeric honeycomb material for causing fluid to flow through the cells thereof.

11. An armor panel as recited in claim 1 wherein said resilient component further includes another panel of thermoplastic elastomeric honeycomb material having apertures formed therein to permit fluid flow therethrough.

12. An armor panel as recited in claim 11 and further comprising means coupled to said another panel of thermoplastic elastomeric honeycomb material for causing fluid to flow through the cells thereof.

13. An armor panel as recited in claim 11 and further comprising:

another rigid armor component disposed between said one panel of thermoplastic elastomeric honeycomb material and said another panel of thermoplastic elastomeric honeycomb material, wherein said resilient component further includes another panel of thermoplastic elastomeric honeycomb material having apertures formed therein to permit fluid flow therethrough.

14. Armor apparatus for shielding a person from injury due to an impacting projectile or the like, comprising:

a plurality of armor panels connected together to provide a shield to capture the impacting projectile, each said panel including, a rigid armor component having an outer face and an inner face and including a first laminated arrangement including a plurality of layers of carbon fiber cloth impregnated with a thermo-setting resin, a second laminated arrangement including a plurality of layers of aramid fabric, and a third laminated arrangement including a plurality of layers of carbon fiber cloth impregnated with a thermo-setting resin, said first, second and third laminated arrangements being thermo compressed together to form said armor component.

15. Armor apparatus as recited in claim 14 wherein each said armor panel further includes;

a resilient component affixed to the inner face of the associated armor component and including at least one honeycomb pad made of thermoplastic elastomeric material, said resilient component being operative to absorb impact energy transmitted thereto from said associated armor component.

16. Armor apparatus as recited in claim 15 wherein each said armor panel is formed to mate with a particular contour of the body of a person to be protected thereby and serves to capture any impacting projectile, and wherein each said resilient component serves to absorb impacting projectile energy to reduce the likelihood of blunt trauma injury to the person.

17. Armor apparatus as recited in claim 16 and further comprising fastener means for attaching each said panel to at least one adjacent panel, said fastening means being adapted to allow each said panel to have a predetermined freedom of movement relative to a panel to which it is attached.

18. Armor apparatus as recited in claim 14 wherein said armor panels are configured and associatively related to collectively provide a shelter for a person.

19. Armor apparatus as recited in claim 14 wherein said armor panels are configured for attachment to a vehicle to provide armor protection therefor.

* * * * *